US010048019B2

(12) United States Patent
Karlen et al.

(10) Patent No.: US 10,048,019 B2
(45) Date of Patent: Aug. 14, 2018

(54) PINS FOR HEAT EXCHANGERS

(71) Applicant: Hamilton Sundstrand Corporation, Charlotte, NC (US)

(72) Inventors: Eric Karlen, Rockford, IL (US); William L. Wentland, Rockford, IL (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 388 days.

(21) Appl. No.: 14/579,120

(22) Filed: Dec. 22, 2014

(65) Prior Publication Data

US 2016/0178287 A1 Jun. 23, 2016

(51) Int. Cl.

| | |
|---|---|
| ***F28F 13/12*** | (2006.01) |
| ***F28F 1/40*** | (2006.01) |
| ***F28F 3/02*** | (2006.01) |

(52) U.S. Cl.

CPC ..... *F28F 1/40* (2013.01); *F28F 1/405* (2013.01); *F28F 3/022* (2013.01); *F28F 13/12* (2013.01); *F28F 2215/00* (2013.01); *F28F 2215/06* (2013.01); *F28F 2215/10* (2013.01)

(58) Field of Classification Search

CPC ..... H01L 23/3677; F28F 3/22
USPC ..... 165/80.3, 80.4, 109.1, 185; 361/699
See application file for complete search history.

(56) References Cited

U.S. PATENT DOCUMENTS

| | | | | |
|---|---|---|---|---|
| 735,945 A * | 8/1903 | Clark | F28F 1/12 | 123/41.69 |
| 855,687 A * | 6/1907 | Barnett | F28F 1/12 | 165/181 |
| 4,798,241 A * | 1/1989 | Jarrett et al. | B01F 5/0614 | 138/38 |
| 5,158,136 A * | 10/1992 | Azar | F28F 1/124 | 165/185 |
| 6,173,758 B1 * | 1/2001 | Ward et al. | F28F 3/022 | 165/185 |
| 2002/0053422 A1 * | 5/2002 | Juslenius et al. | F28D 7/024 | 165/133 |

(Continued)

FOREIGN PATENT DOCUMENTS

| | | |
|---|---|---|
| DE | 2928014 A1 | 1/1980 |
| EP | 1533475 A2 | 5/2005 |

(Continued)

OTHER PUBLICATIONS

Extended European Search Report prepared, of the European Patent Office, dated Apr. 13, 2016, issued in corresponding European Patent Application No. 15201766.1.

*Primary Examiner* — Allen Flanigan
(74) *Attorney, Agent, or Firm* — Locke Lord LLP; Daniel J. Fiorello; Scott D. Wofsy

(57) ABSTRACT

A heat exchanger includes a body defining a flow channel, and a pin extending across the flow channel, the pin including an at least partially non-cylindrical shape. The pin can be a double helix pin including two spiral branches defining a double helix shape. The two branches can include a uniform winding radius. The two branches include a non-uniform winding radius. The non-uniform winding radius can include a base radius and a midpoint radius, wherein the midpoint radius is smaller than the base radius. The two branches can be joined together by one or more cross-members.

5 Claims, 4 Drawing Sheets

(56) References Cited

U.S. PATENT DOCUMENTS

| | | | | |
|---|---|---|---|---|
| 2004/0150956 | A1* | 8/2004 | Conte | H01L 23/3677 361/709 |
| 2007/0131386 | A1* | 6/2007 | Tsai | G06F 1/20 165/80.3 |
| 2008/0066888 | A1 | 3/2008 | Tong et al. | |
| 2009/0145581 | A1 | 6/2009 | Hoffman et al. | |
| 2011/0079376 | A1 | 4/2011 | Loong et al. | |
| 2013/0188317 | A1 | 7/2013 | Ho | |

FOREIGN PATENT DOCUMENTS

| | | | |
|---|---|---|---|
| EP | 2204629 | A2 | 7/2010 |
| JP | 2006138538 | A | 6/2006 |

* cited by examiner

PINS FOR HEAT EXCHANGERS

BACKGROUND

1. Field

The present disclosure relates to heat exchangers, more specifically to heat exchangers with pins disposed in flow channels thereof.

2. Description of Related Art

Traditional heat exchangers can be cast or pieced together to form at least one channel defined therein for flow to pass therethrough. Certain heat exchangers include pins that extend across these channels which can increase thermal efficiency of the heat exchanger as well as providing added structural support for the channel. These pins are cylindrical.

Such conventional methods and systems have generally been considered satisfactory for their intended purpose. However, there is still a need in the art for improved heat exchangers with enhanced efficiency over traditional heat exchangers. The present disclosure provides a solution for this need.

SUMMARY

A heat exchanger includes a body defining a flow channel, and a pin extending across the flow channel, the pin including an at least partially non-cylindrical shape. The pin can be a double helix pin including two spiral branches defining a double helix shape. The two branches can include a uniform winding radius.

In certain embodiments, the two branches include a non-uniform winding radius. The non-uniform winding radius can include a base radius and a midpoint radius, wherein the midpoint radius is smaller than the base radius. The two branches can be joined together by one or more cross-members.

In certain embodiments, the pin can include a plurality of branches extending away from a trunk portion of the pin. At least one of the plurality of branches can curve back to the trunk portion of the pin to form a loop.

The trunk portion and/or one or more of the branches can include a hole defined therethrough. The branches can connect to an electronics side of the body or any other suitable portion of the body, for example, to improve thermal transfer. In certain embodiments, the pin can include a plurality of multi-branches connected to each other.

The heat exchanger can include a plurality of pins as described herein. The plurality of pins can include pins of different shape or pins of only one shape. The plurality of pins can be defined in the channel in a predetermined pattern relative to each other.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
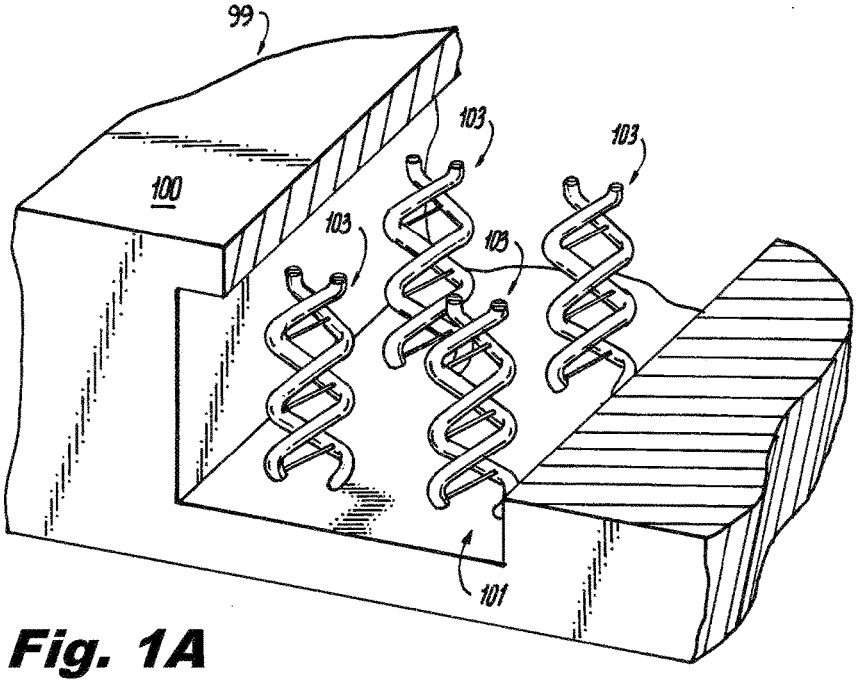
FIG. 1A is a perspective cut-away view of a portion of a heat exchanger in accordance with this disclosure, showing double helix pins disposed in a flow channel of the heat exchanger.

Reference will now be made to the drawings wherein like reference numerals identify similar structural features or aspects of the subject disclosure. For purposes of explanation and illustration, and not limitation, an illustrative view of an embodiment of a heat exchanger in accordance with the disclosure is shown in FIG. 1A and is designated generally by reference character 100. Other embodiments and/or aspects of this disclosure are shown in FIGS. 1B-6. The systems and methods described herein can be used to enhance the efficiency of heat exchangers over traditional heat exchangers.

Figure 1B:
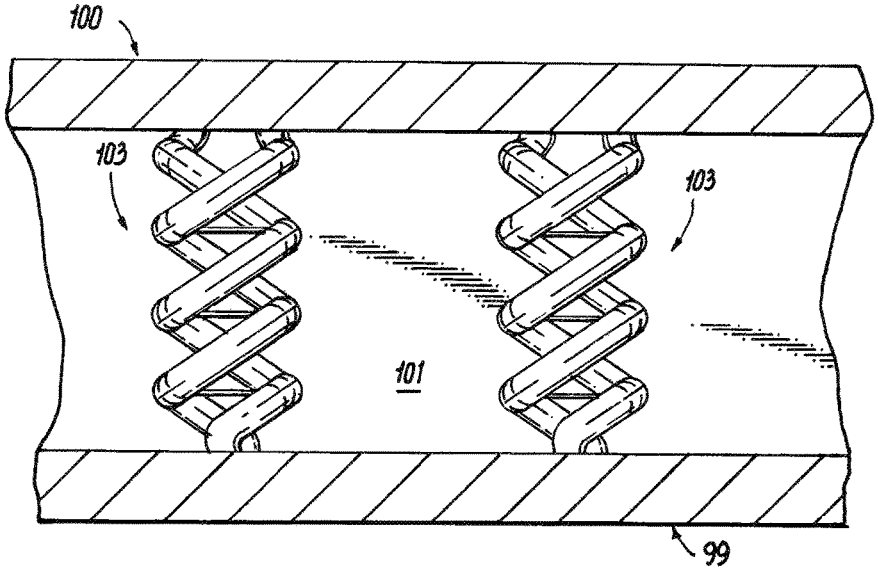
FIG. 1B is a side cross-sectional view of the heat exchanger of FIG. 1A.

Referring to FIGS. 1A and 1B, a heat exchanger 99 includes a body 100 defining a flow channel 101. The flow channel 101 can be formed in the body 100 using any suitable process (e.g., molding, casting, drilling, cutting) and/or can be defined by assembling one or more pieces together. In certain embodiments, the body 100 is formed using suitable additive manufacturing processes.

Figure 2A:
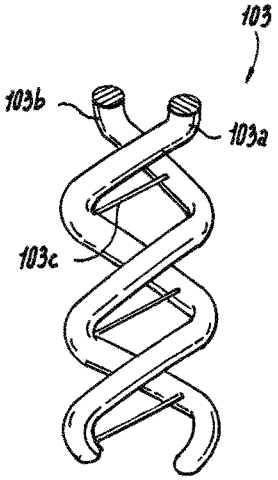
FIG. 2A is a perspective view of a double helix pin in accordance with this disclosure, showing two branches connected by a plurality of cross-members.
Figure 2B:
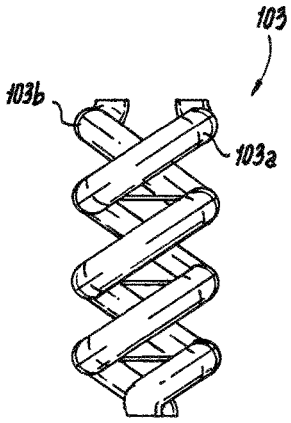
FIG. 2B is a side view of the pin of FIG. 2A.
Figure 2C:
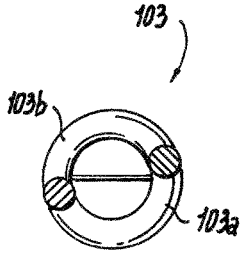
FIG. 2C is a plan view of the pin of FIG. 2A.

As shown in FIGS. 1A and 1B, the heat exchanger 99 can include a double helix pin 103 extending across the flow channel 101. As shown in FIGS. 2A, 2B, and 2C, the double helix pin 103 can include two spiral branches 103*a*, 103*b* defining the double helix structure. The two branches can be joined together by one or more cross-members 103*c* similar to a DNA structure. While a double helix is shown, any suitable number of branches of a helix can be included (e.g., a single helix, triple helix, etc.). It is also contemplated that one or more holes can be defined through the branches of the helix as desired for added for pressure drop relief.

Figure 3A:
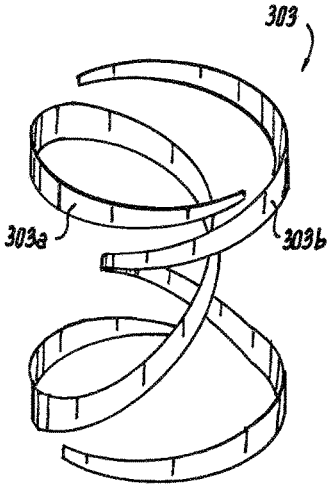
FIG. 3A is a perspective view of a double helix pin in accordance with this disclosure, showing two branches connected by a plurality of cross-members.
Figure 3B:
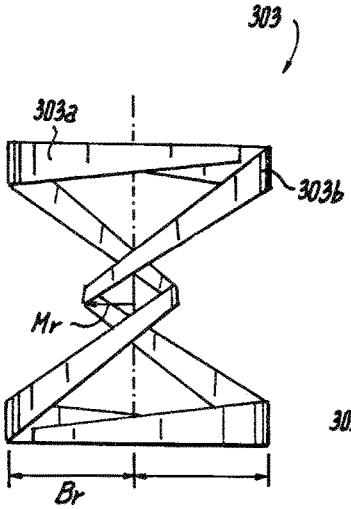
FIG. 3B is a side view of the pin of FIG. 3A.
Figure 3C:
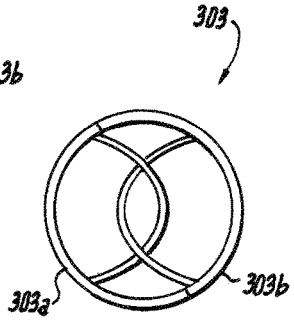
FIG. 3C is a plan view of the pin of FIG. 3A.

The two branches 103*a*, 103*b* can include a uniform winding radius such that the branches 103*a*, 103*b* wind around a constant diameter from top to bottom. Referring to FIGS. 3A, 3B, and 3C, in certain embodiments, a double helix pin 303 can include two branches 303*a*, 303*b* that have a non-uniform winding radius. For example, as shown, the non-uniform winding radius can include a base radius $B_r$ and a midpoint radius $M_r$ such that the midpoint radius $M_r$ is smaller than the base radius $B_r$.

Figure 4A:
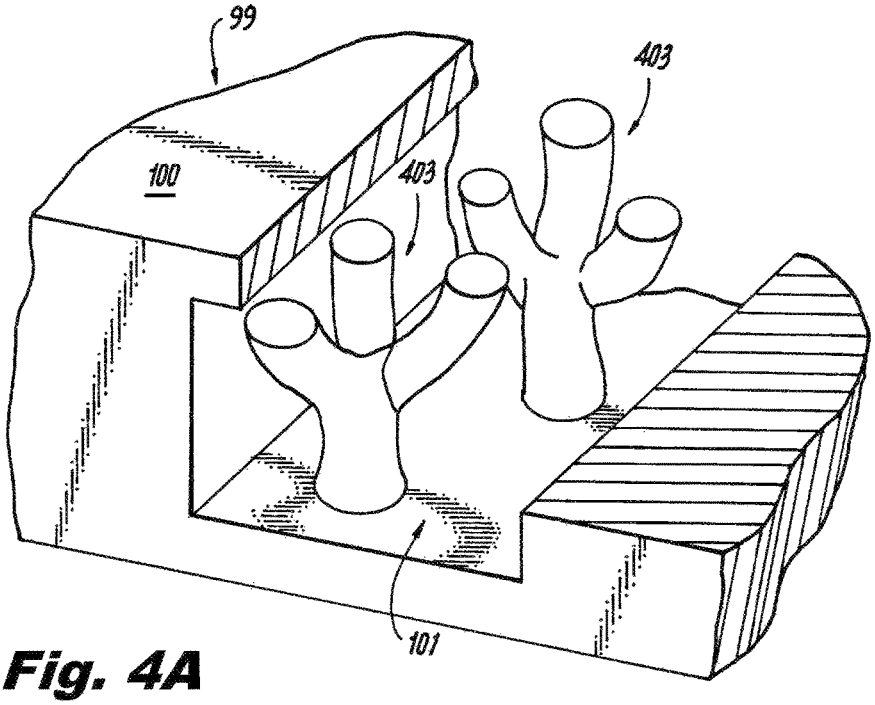
FIG. 4A is a perspective cut-away view of a portion of a heat exchanger in accordance with this disclosure, showing branched pins disposed in a flow channel of the heat exchanger.
Figure 4B:
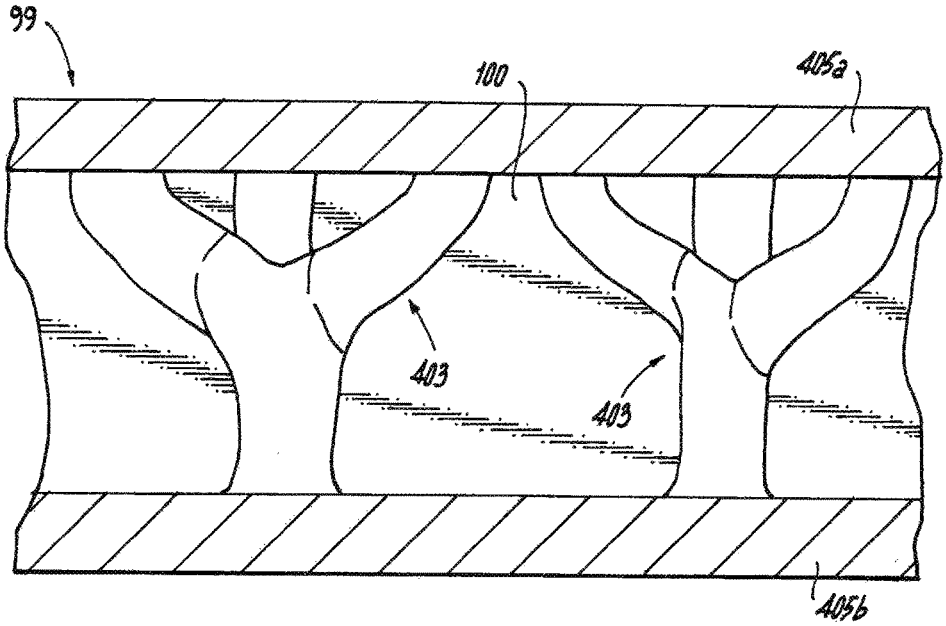
FIG. 4B is a side cross-sectional view of the heat exchanger of FIG. 4A.

Referring to FIGS. 4A and 4B, the heat exchanger 99 can include one or more branched pins 403 which have one or more of branches 403*b* extending away from a trunk portion 403*a* of the pin 403. The branches 403*b* can connect to an electronics side 405*a* of the body 100, for example other suitable portion of the body 100. The electronics side 405*a* of the body can include a side of the body 100 that is configured to attach to an electronics device.

Figure 5A:
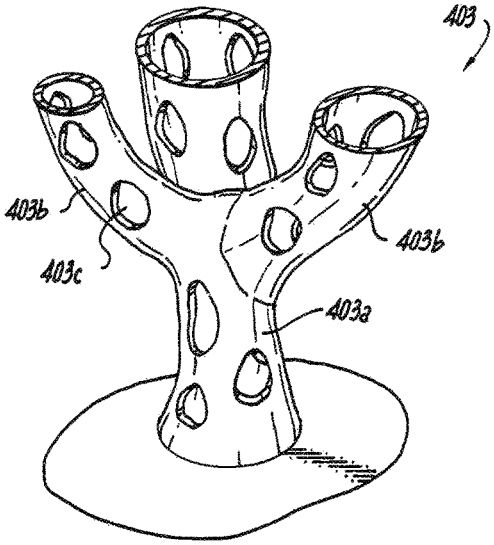
FIG. 5A is a perspective view of a branched pin in accordance with this disclosure, showing branches extending from a trunk portion.

Referring additionally to FIG. 5A, while the branches 403*b* are shown only extending away from the trunk 403*a*, it is contemplated that at least one of the plurality of branches 403*b* can curve back to the trunk portion 403*a* of the branched pin 403 to create a loop as indicated with dashed lines in FIG. 5A. As shown in FIG. 5A, the pin 403 can include one or more holes 403*c* defined therethrough for allowing flow to flow through the structure of pin 403.

Figure 5B:
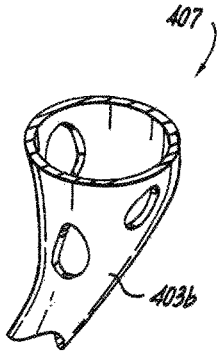
FIG. 5B is a side view of a portion of a branch of the pin of FIG. 5A.

Referring to FIG. 5B, it is contemplated that one or more of the branches 403*b* of the pin 403 can include a flared end 407 to increase the surface area for thermal enhancement and/or for additional support for the structure of the body 100 defining the channel 101.

Figure 6:
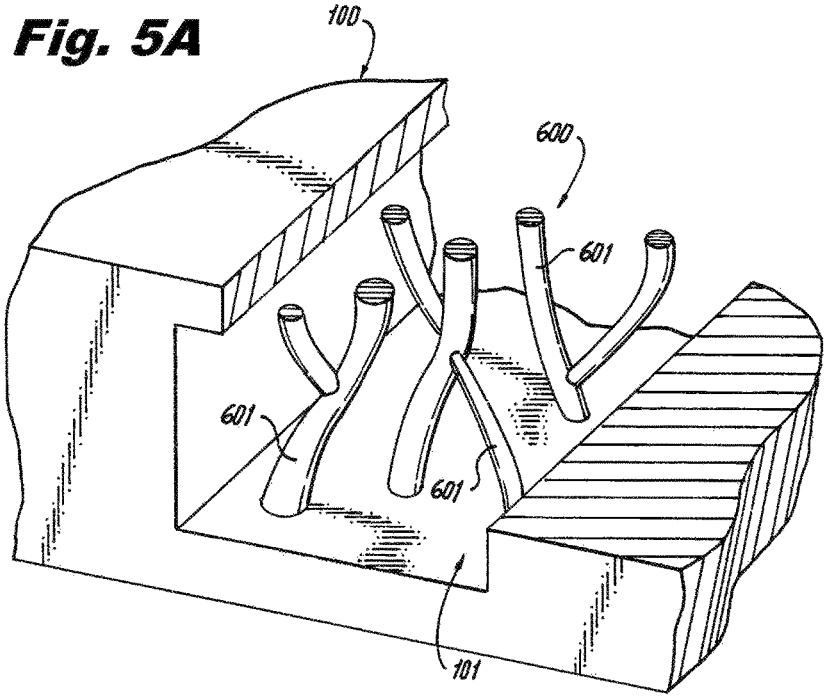
FIG. 6 is a perspective cut-away view of a portion of a heat exchanger in accordance with this disclosure, showing another embodiment of branched pins disposed in a flow channel of the heat exchanger.

In certain embodiments, referring to FIG. 6, the heat exchanger 99 can include a multi-branch pin 600 that includes a plurality of multi-branches 601 connected to each other. The multi-branches 601 can branch from one another to form a branch coral shape or any other suitable configuration (e.g., randomized branching).

It is contemplated that the heat exchanger 99 can include a plurality of pins that include pins of different shape or pins of only one shape. The plurality of pins can be defined in the channel 101 in a predetermined pattern relative to each other or can be defined randomly.

While the pins as described above are shown to be of a double helix or branching shape, any suitable at least partially non-cylindrical (e.g., cylindrical pins with holes therein) is contemplated herein.

A method includes additively manufacturing a pin as described above. The method can include additively manufacturing the body 100 to define the channel 101 along with the pins as described above. In embodiments, it is contemplated that the pins as described above can be additively manufactured in channel 101 of a body 100 that was cast, cut, assembled, or otherwise formed to define the channel 101. Any other suitable methods of manufacturing the pins as described above are contemplated herein.

The methods and systems of the present disclosure, as described above and shown in the drawings, provide for heat transfer devices with superior properties including enhanced thermal efficiency. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A heat exchanger, comprising:

a body defining a flow channel; and a pin extending across the flow channel, the pin including an at least partially non-cylindrical shape, wherein the pin is a double helix pin including two spiral branches defining a double helix shape, each branch having two ends, wherein the two branches are joined together by one or more cross-members, wherein the two branches extend across the flow channel such that the branches are connected to the body at two sides of the flow channel at respective ends of each branch.

2. The heat exchanger of claim 1, wherein the two branches includes a uniform winding radius.

3. The heat exchanger of claim 1, further comprising a plurality of pins.

4. The heat exchanger of claim 3, wherein the plurality of pins includes pins of only one shape.

5. The heat exchanger of claim 3, wherein the plurality of pins are defined in the channel in a predetermined pattern relative to each other.

* * * * *